US008355235B2

(12) United States Patent
Machida et al.

(10) Patent No.: US 8,355,235 B2
(45) Date of Patent: Jan. 15, 2013

(54) DRIVING APPARATUS AND CONTROL METHOD FOR ELECTRIC ACTUATOR

(75) Inventors: Kenichi Machida, Isesaki (JP); Satoru Watanabe, Isesaki (JP)

(73) Assignee: Hitachi, Ltd., Tokyo (JP)

( * ) Notice: Subject to any disclaimer, the term of this patent is extended or adjusted under 35 U.S.C. 154(b) by 727 days.

(21) Appl. No.: 11/052,244

(22) Filed: Feb. 8, 2005

(65) Prior Publication Data

US 2005/0174717 A1 Aug. 11, 2005

(30) Foreign Application Priority Data

Feb. 9, 2004 (JP) ..... 2004-031728

(51) Int. Cl.
*H01H 47/00* (2006.01)

(52) U.S. Cl. ..... 361/160; 700/12; 361/93.1; 123/399; 123/90.16; 123/90.18; 123/396

(58) Field of Classification Search ..... 361/160, 361/93.1; 700/12; 123/399, 90.16, 90.18, 123/396

See application file for complete search history.

(56) References Cited

U.S. PATENT DOCUMENTS

| | | | | |
|---|---|---|---|---|
| 3,878,401 | A * | 4/1975 | Ronnen | 290/40 R |
| 4,255,789 | A * | 3/1981 | Hartford et al. | 701/108 |
| 4,680,512 | A | 7/1987 | Melocik | |
| 4,736,810 | A | 4/1988 | Morishita et al. | |
| 5,024,191 | A * | 6/1991 | Nagahiro et al. | 123/198 D |
| 6,073,610 | A * | 6/2000 | Matsumoto et al. | 123/396 |
| 6,135,085 | A * | 10/2000 | Toyohara et al. | 123/306 |
| 6,230,094 | B1 | 5/2001 | Ohashi et al. | |
| 6,390,063 | B1 * | 5/2002 | Obata et al. | 123/399 |
| 6,405,697 | B2 * | 6/2002 | Mikame | 123/90.18 |
| 2002/0066436 | A1 * | 6/2002 | Majima et al. | 123/406.47 |
| 2002/0166524 | A1 * | 11/2002 | Nakamura et al. | 123/90.16 |

FOREIGN PATENT DOCUMENTS

| | | | |
|---|---|---|---|
| EP | 0572961 | A2 | 12/1993 |
| EP | 0575854 | A2 | 12/1993 |
| EP | 1241073 (B1) | | 2/2005 |
| JP | 02-168811 | A | 6/1990 |
| JP | 07-182003 | A | 7/1995 |
| JP | 2001-254637 | A | 9/2001 |
| JP | 2001-310750 | A | 11/2001 |
| JP | 2003-222052 | A | 8/2003 |

* cited by examiner

*Primary Examiner* — Tejal Gami
(74) *Attorney, Agent, or Firm* — Foley & Lardner LLP

(57) ABSTRACT

A plurality of reference signals output from a controller which computes an operation amount of an electric actuator is subjected to the logical operation, and the power supply to a drive circuit for the electric actuator is shut off based on an output by the logical operation.

12 Claims, 15 Drawing Sheets

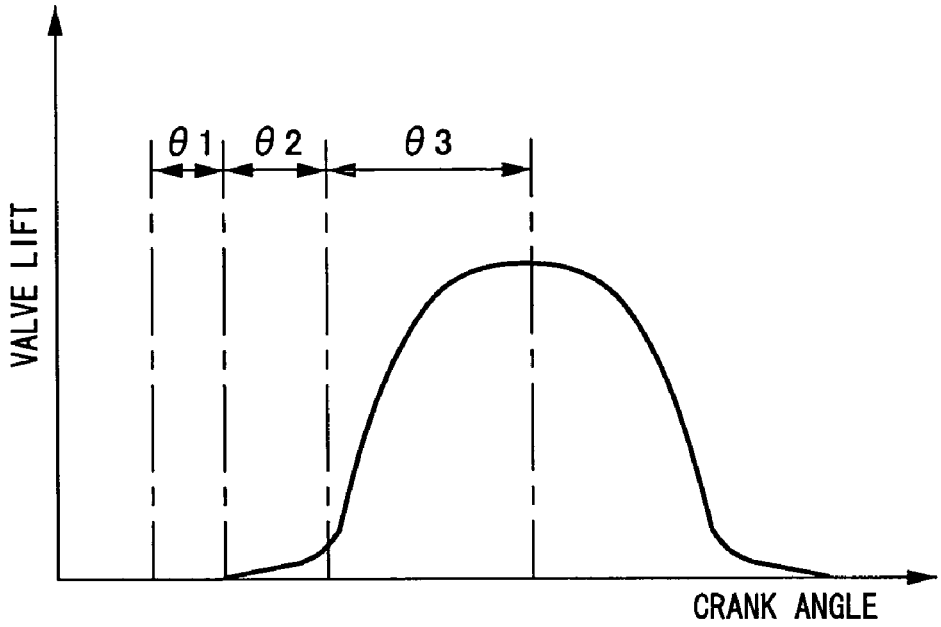
FIG.9
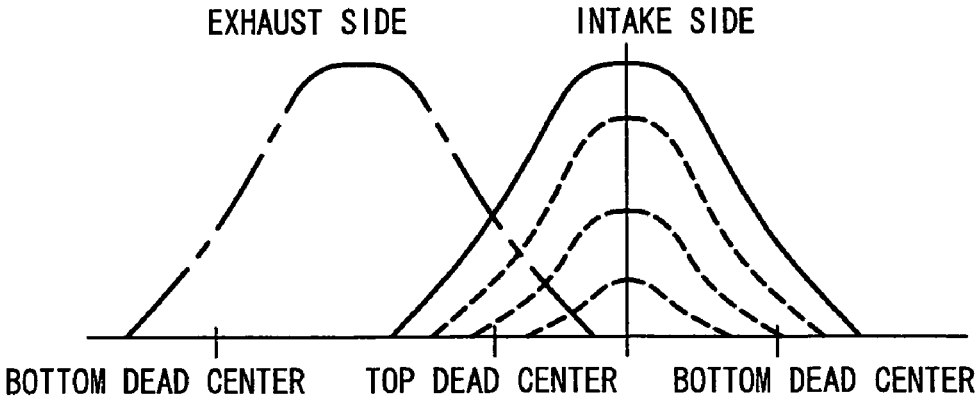

DRIVING APPARATUS AND CONTROL METHOD FOR ELECTRIC ACTUATOR

BACKGROUND OF THE INVENTION

1. Field of the Invention

The present invention relates to a driving apparatus and a control method for an electric actuator.

2. Description of the Related Art

Japanese Unexamined Patent Publication No. 2001-254637 discloses an apparatus for diagnosing the malfunction of a variable valve lift mechanism which varies a lift amount of an engine valve by an electric actuator.

In the above diagnosis apparatus, it is judged that the variable valve lift mechanism is malfunctioned, when a change in lift amount is smaller than a predetermined value and also when an absolute value of the deviation between the lift amount and a target value exceeds a predetermined value.

In the case where a computing unit that computes an operation amount of the variable valve lift mechanism is operated normally, it is possible to execute the failure diagnosis of the variable valve lift mechanism and the processing based on a result of the failure diagnosis.

However, if the computing unit fails, it becomes impossible to appropriately execute the failure diagnosis and the processing based on the result of the failure diagnosis. As a result, there is a possibility that the lift amount of the engine valve is abnormally controlled.

SUMMARY OF THE INVENTION

It is therefore an object of the present invention to provide a driving apparatus and a control method, capable of reliably stopping the driving of an electric actuator when a computing unit that computes an operation amount of the electric actuator fails.

In order to achieve the above object, according to the present invention, a plurality of reference signals output from a computing unit is subjected to the logical operation, and the power supply to a drive circuit for an electric actuator is shut off according to an output by the logical operation.

Further, according to the present invention, a frequency of a reference signal output from a computing unit is measured, the measured frequency and a previously set frequency are compared with each other, and the power supply to a drive circuit for an electric actuator is shut off according to a comparison result.

Moreover, according to the present invention, it is diagnosed whether or not a computing unit has failed, a reference signal output from the computing unit and a diagnosis signal indicating a result of the failure diagnosis are subjected to the logical operation, and the power supply to a drive circuit for an electric actuator is shut off according to an output by the logical operation.

The other objects and features of the invention will become understood from the following description with reference to the accompanying drawings.

BRIEF DESCRIPTION OF THE DRAWINGS

FIG. 8 is a graph showing a lift characteristic of an intake valve in the variable valve characteristic mechanism.

FIG. 9 is a graph showing a correlation between valve timing and a lift amount in the variable valve event and lift mechanism.

PREFERRED EMBODIMENTS

Figure 1:
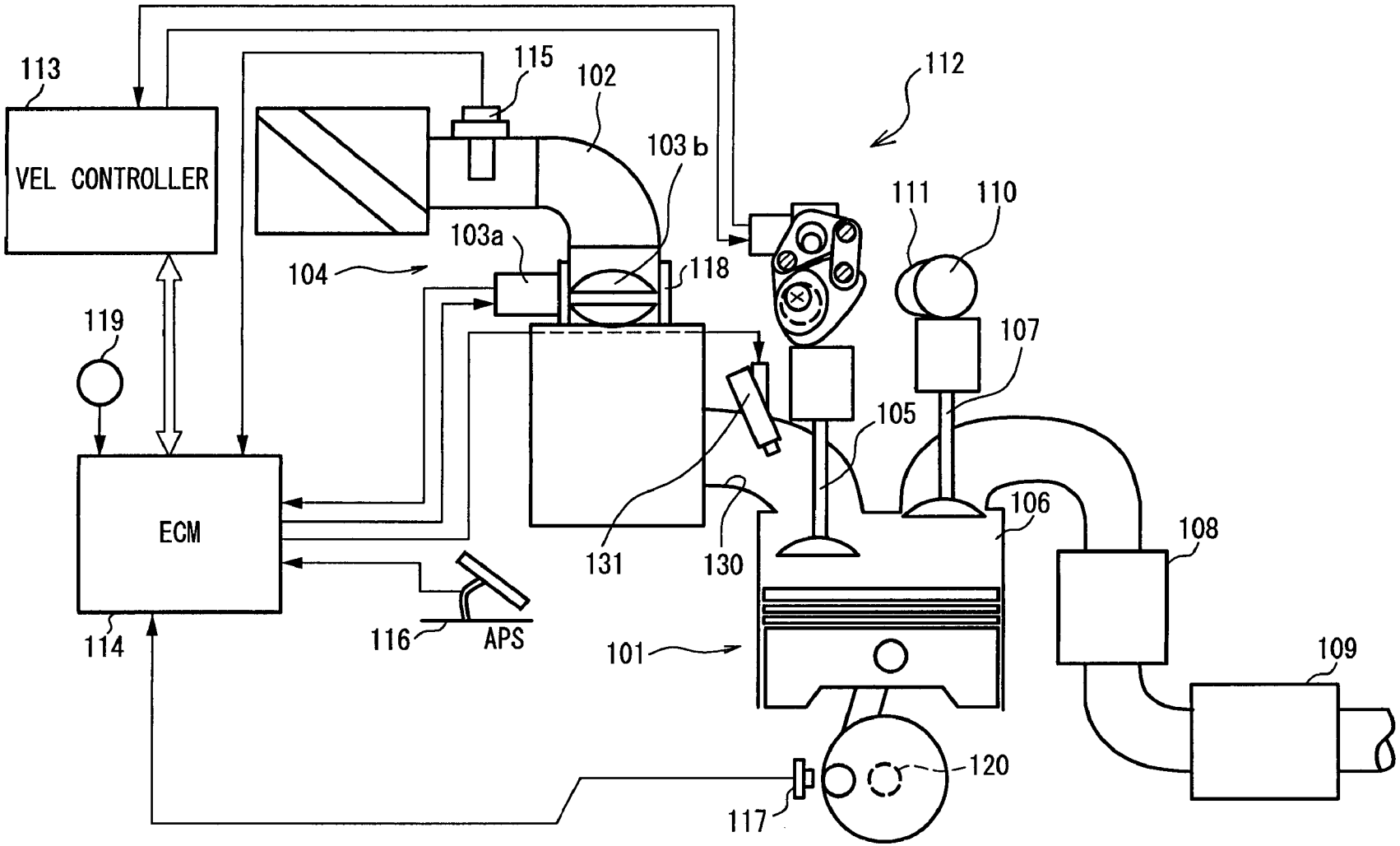
FIG. 1 is a systematic diagram of an engine in an embodiment of the present invention.

FIG. 1 is a systematic diagram of a vehicle engine in an embodiment.

In FIG. 1, in an intake pipe 102 of an internal combustion engine 101, an electronically controlled throttle 104 is disposed.

Electronically controlled throttle 104 is a device for driving a throttle valve 103*b* to open and close by a throttle motor 103*a*.

Then, air is sucked into a combustion chamber 106 of engine 101 via electronically controlled throttle 104 and an intake valve 105.

A combusted exhaust gas is discharged from combustion chamber 106 via an exhaust valve 107, and thereafter, is purified by a front catalyst 108 and a rear catalyst 109, to be emitted into the atmosphere.

Exhaust valve 107 is driven by a cam 111 axially supported by an exhaust side camshaft 110, to open and close, while maintaining a fixed lift amount, a fixed valve operating angle and fixed valve timing.

On the other hand, there is disposed a variable valve event and lift (VEL) mechanism 112 which continuously varies a lift amount of intake valve 105 as well as an operating angle thereof.

Here, an engine control module (ECM) 114 and a VEL controller 113 are disposed.

ECM 114 computes a target lift amount, to send it to VEL controller 113.

VEL controller 113 which received data of the target lift amount feedback controls VEL mechanism 112 so as to obtain the target lift amount.

ECM 114 receives detection signals from various sensors.

As the various sensors, there are disposed an air flow meter 115 detecting an intake air flow amount of engine 101, an accelerator opening sensor 116 detecting an accelerator opening, a crank angle sensor 117 taking a crank rotation signal out of crankshaft 120, a throttle sensor 118 detecting an opening TVO of throttle valve 103*b* and a water temperature sensor 119 detecting a cooling water temperature of engine 101.

Further, a fuel injection valve 131 is disposed on an intake port 130 at the upstream side of intake valve 105.

Fuel injection valve 131 is driven to open based on an injection pulse signal from ECM 114 to inject fuel of an amount proportional to the injection pulse width of the injection pulse signal.

Further, ECM 114 computes ignition timing (ignition advance value) based on the fuel injection pulse width and an engine rotation speed, to control the ignition timing by an ignition plug (not shown in the figure).

Figure 2:
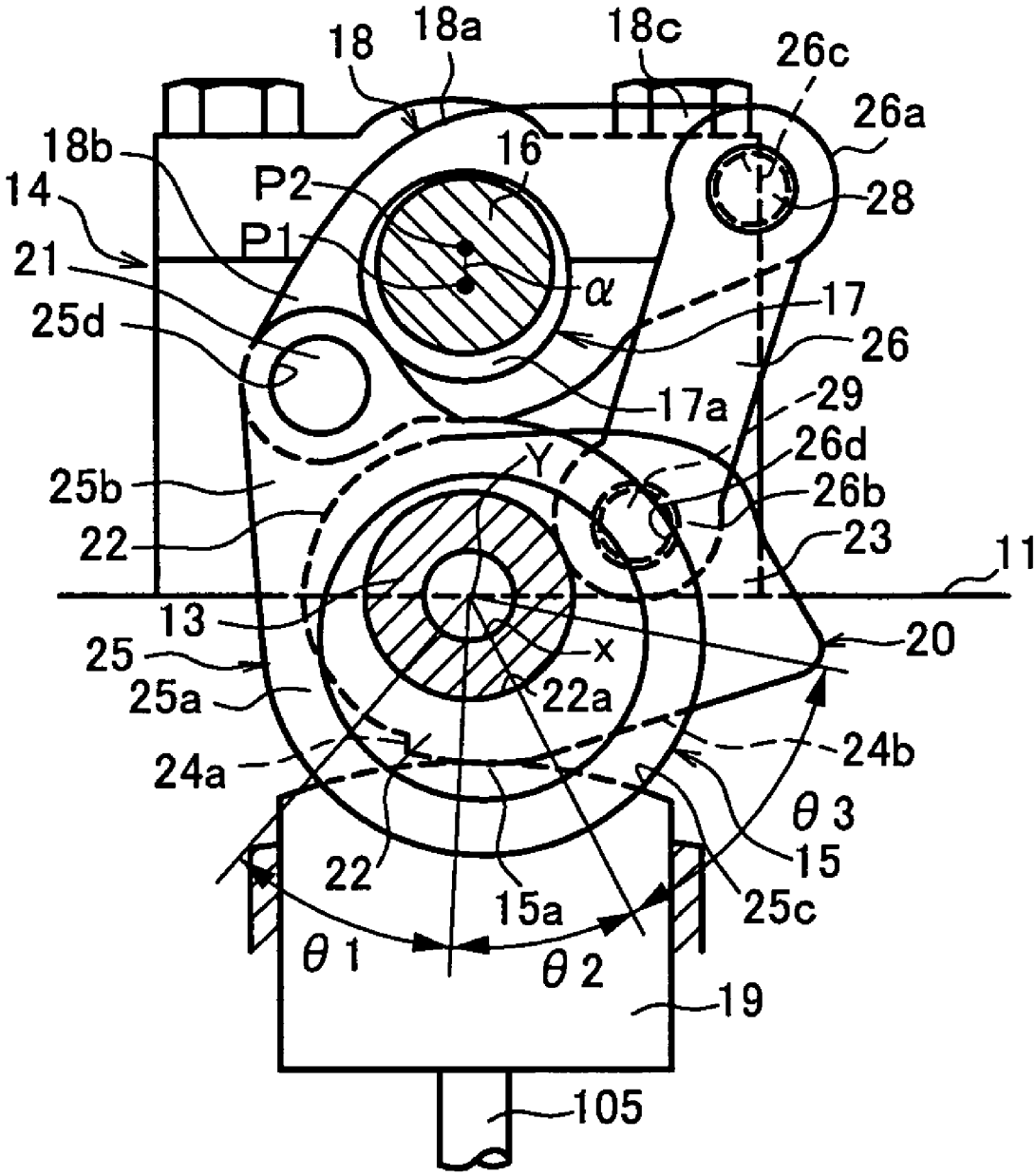
FIG. 2 is a cross section view showing a variable valve event and lift mechanism in the embodiment (A-A cross section view in FIG. 3).
Figure 3:
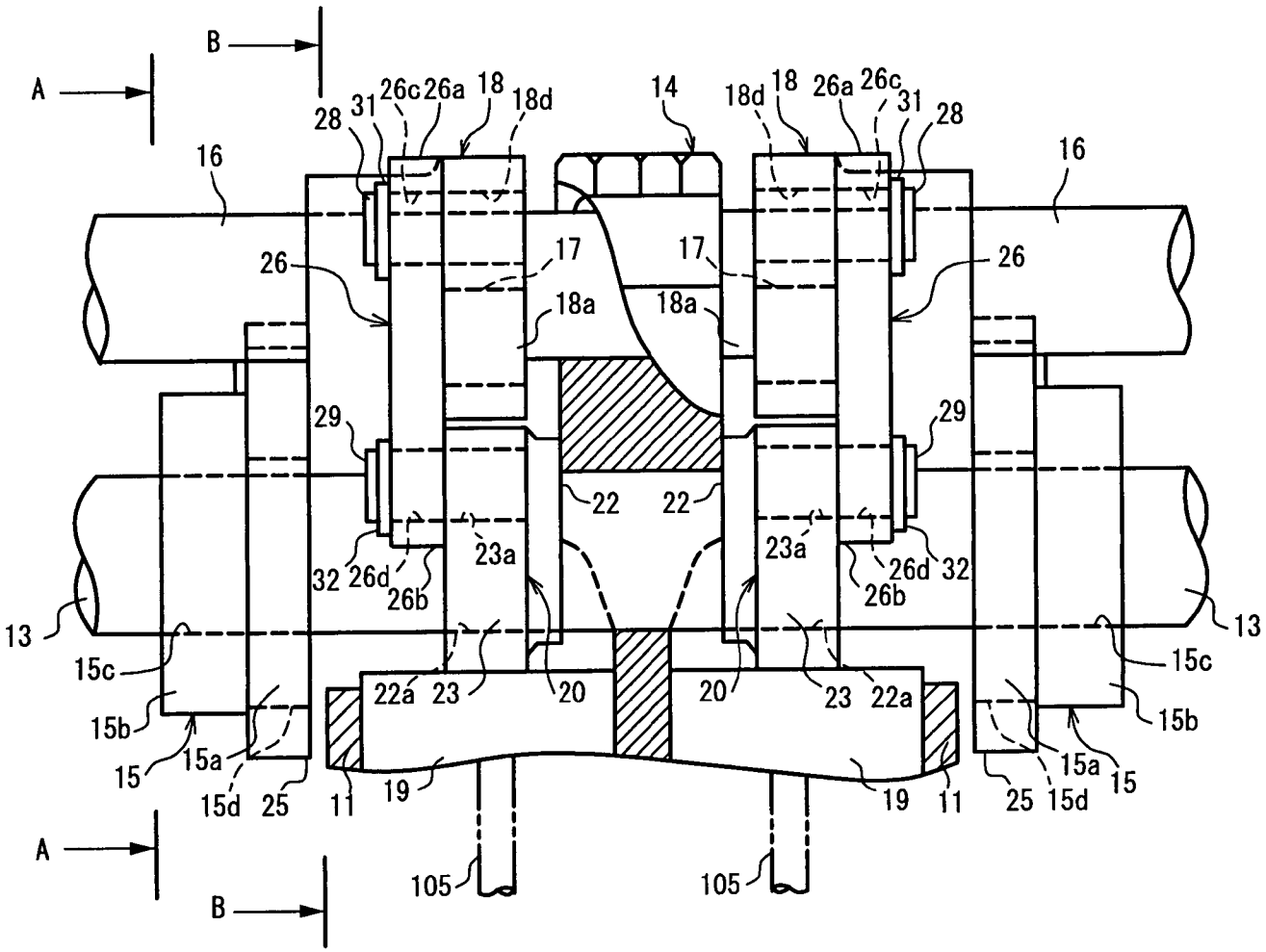
FIG. 3 is a side elevation view of the variable valve event and lift mechanism.
Figure 4:
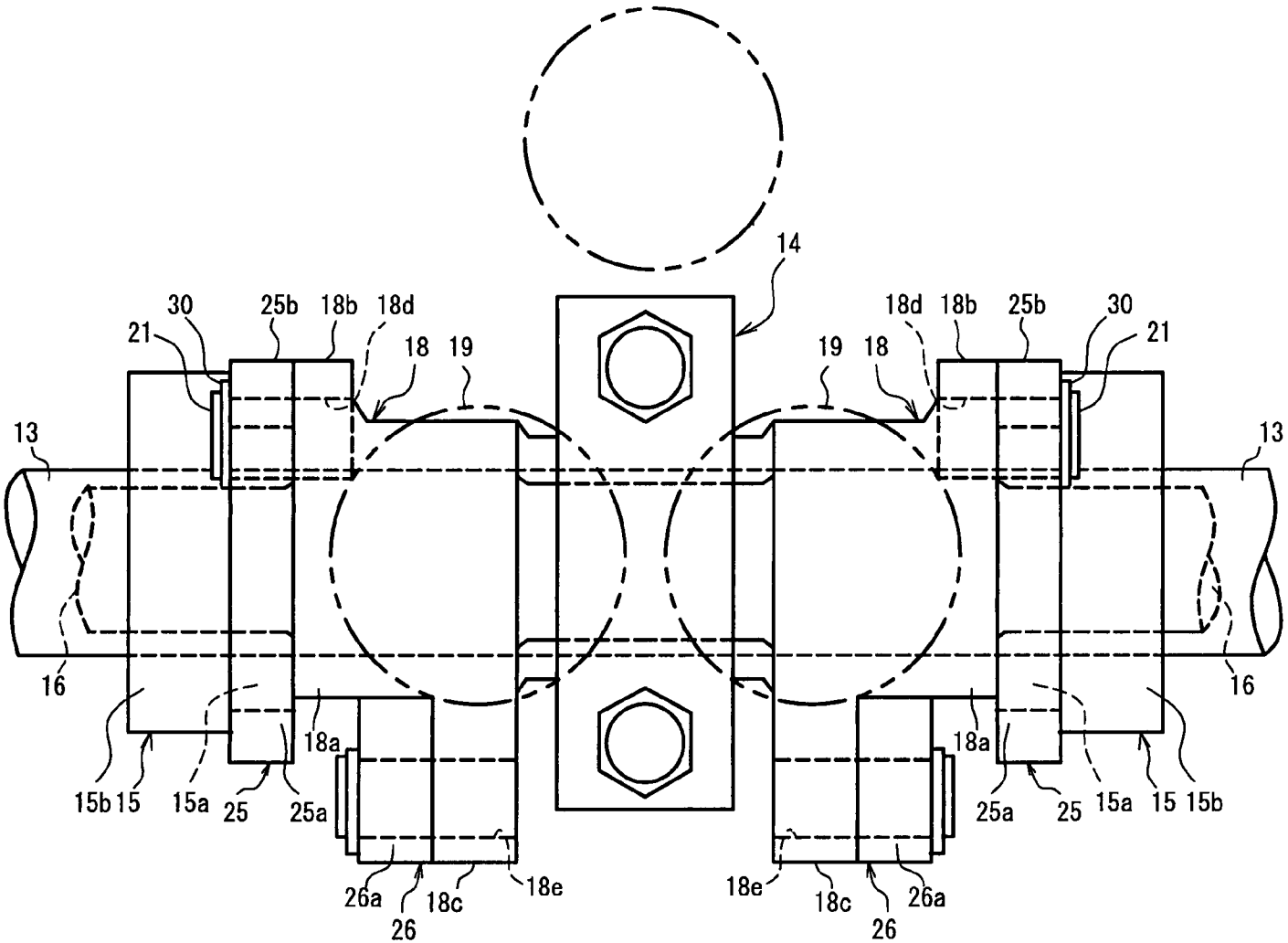
FIG. 4 is a top plan view of the variable valve event and lift mechanism.

FIG. 2 to FIG. 4 show in detail the structure of VEL mechanism 112.

VEL mechanism 112 shown in FIG. 2 to FIG. 4 includes a pair of intake valves 105, 105, a hollow camshaft 13 rotatably supported by a cam bearing 14 of a cylinder head 11, two eccentric cams 15, 15 (drive cams) being rotation cams which are axially supported by camshaft 13, a control shaft 16 rotatably supported by cam bearing 14 and arranged in parallel at an upper position of camshaft 13, a pair of rocker arms 18, 18 swingingly supported by control shaft 16 through a control cam 17, and a pair of independent swing cams 20, 20 disposed to upper end portions of intake valves 105, 105 through valve lifters 19, 19, respectively.

Eccentric cams 15, 15 are connected with rocker arms 18, 18 by link arms 25, 25, respectively. Rocker arms 18, 18 are connected with swing cams 20, 20 by link members 26, 26.

Rocker arms 18, 18, link arms 25, 25, and link members 26, 26 constitute a transmission mechanism.

Figure 5:
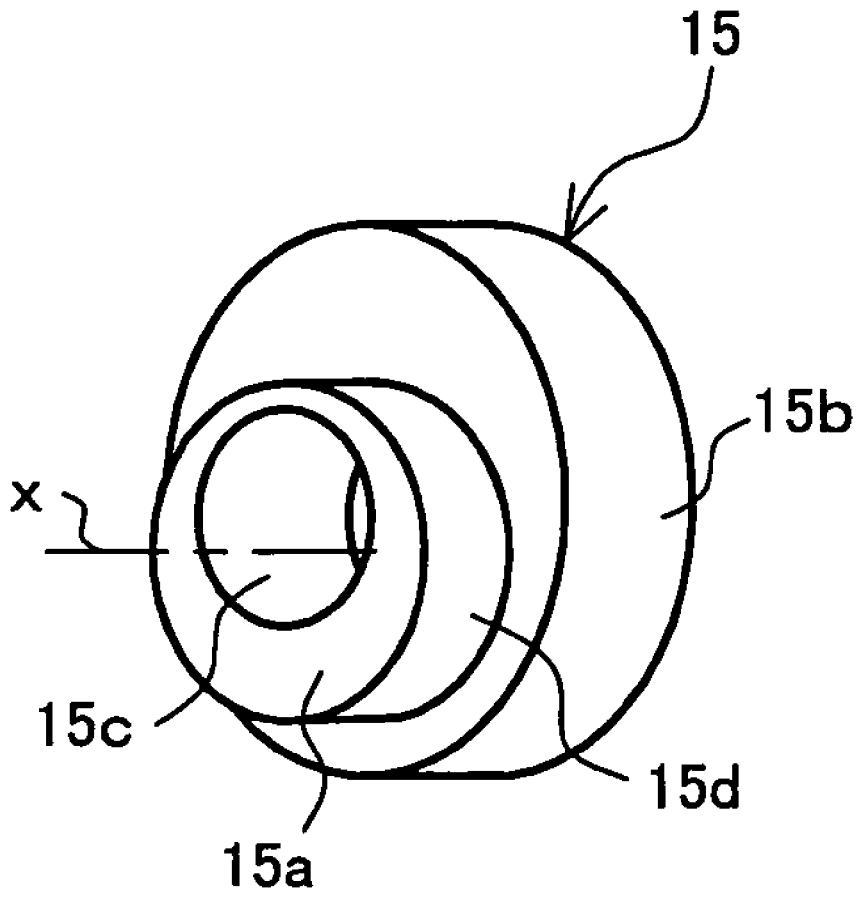
FIG. 5 is a perspective view showing an eccentric cam for use in the variable valve event and lift mechanism.

Each eccentric cam 15, as shown in FIG. 5, is formed in a substantially ring shape and includes a cam body 15*a* of small diameter, a flange portion 15*b* integrally formed on an outer surface of cam body 15*a*. A camshaft insertion hole 15*c* is formed through the interior of eccentric cam 15 in an axial direction, and also a center axis X of cam body 15*a* is biased from a center axis Y of camshaft 13 by a predetermined amount.

Eccentric cams 15, 15 are pressed and fixed to camshaft 13 via camshaft insertion holes 15*c* at outsides of valve lifters 19, 19, respectively, so as not to interfere with valve lifters 19, 19.

Each rocker arm 18, as shown in FIG. 4, is bent and formed in a substantially crank shape, and a central base portion 18*a* thereof is rotatably supported by control cam 17.

A pin hole 18*d* is formed through one end portion 18*b* which is formed to protrude from an outer end portion of base portion 18*a*. A pin 21 to be connected with a tip portion of link arm 25 is pressed into pin hole 18*d*. A pin hole 18*e* is formed through the other end portion 18*c* which is formed to protrude from an inner end portion of base portion 18*a*. A pin 28 to be connected with one end portion 26*a* (to be described later) of each link member 26 is pressed into pin hole 18*e*.

Control cam 17 is formed in a cylindrical shape and fixed to an outer periphery of control shaft 16. As shown in FIG. 2, a center axis P1 position of control cam 17 is biased from a center axis P2 position of control shaft 16 by $\alpha$.

Figure 6:
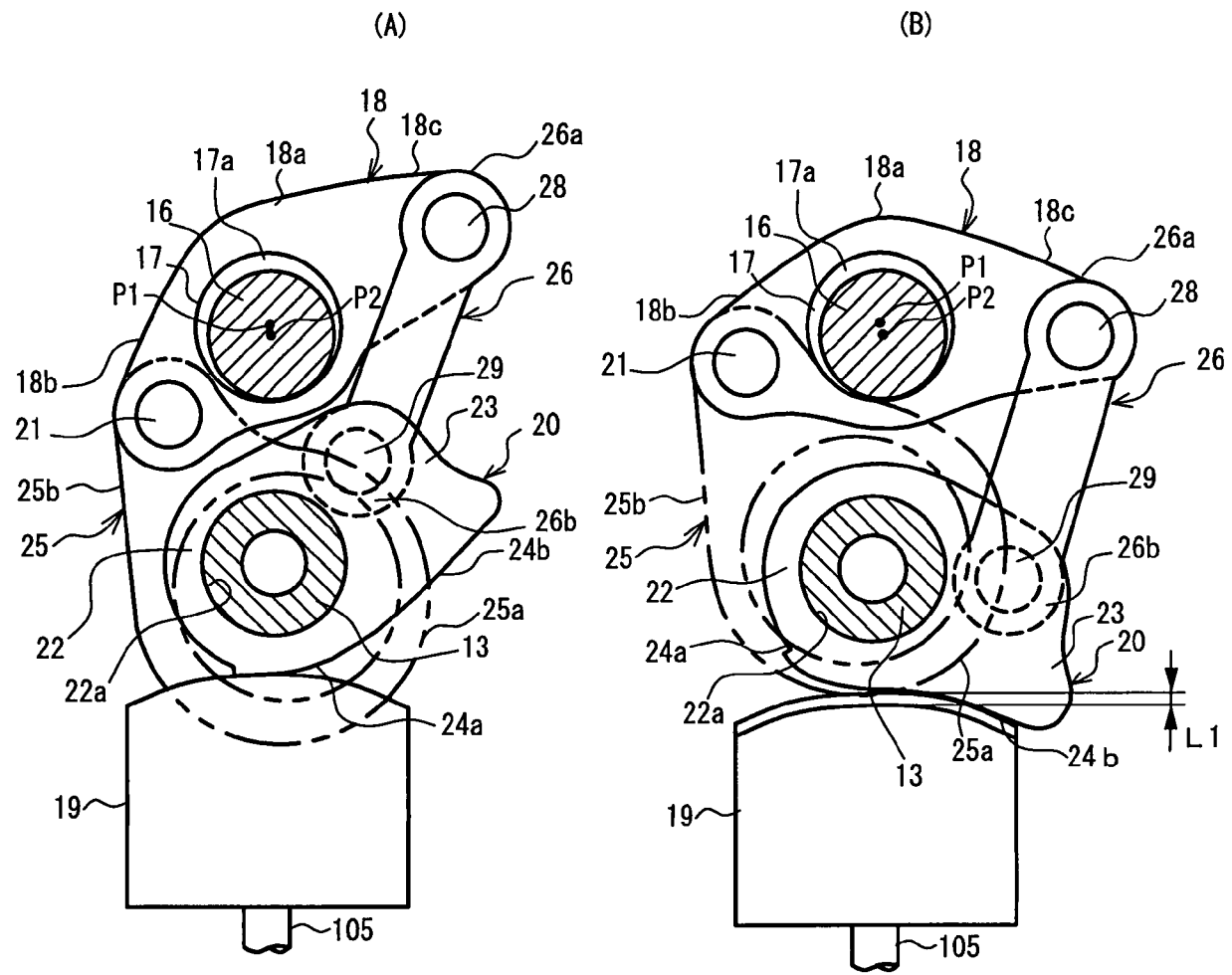
FIG. 6 is a cross section view showing a low lift control condition of the variable valve event and lift mechanism (B-B cross section view of FIG. 3).
Figure 7:
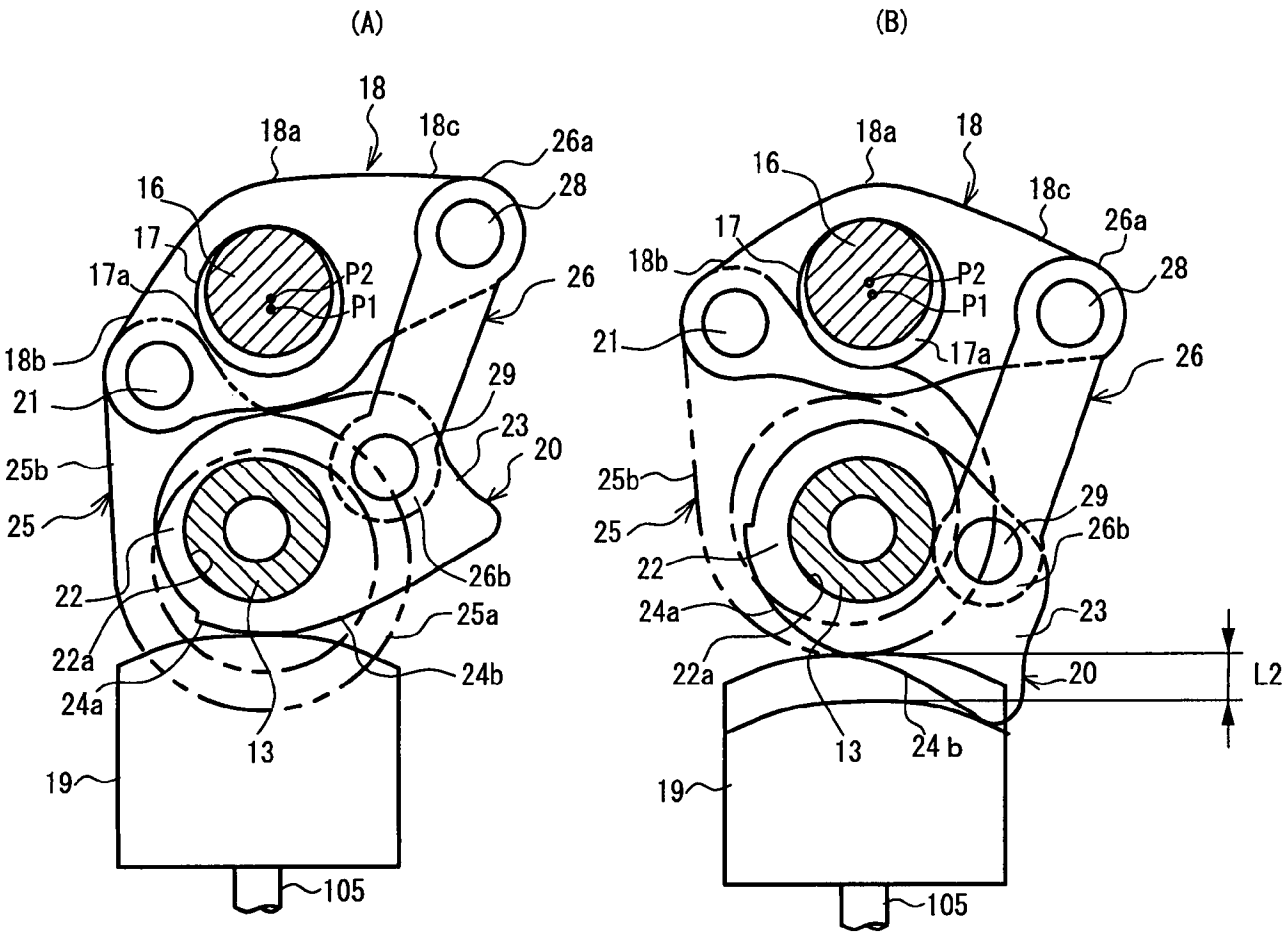
FIG. 7 is a cross section view showing a high lift control condition of the variable valve event and lift mechanism (B-B cross section view of FIG. 3).

Swing cam 20 is formed in a substantially lateral U-shape as shown in FIG. 2, FIG. 6 and FIG. 7, and a supporting hole 22*a* is formed through a substantially ring-shaped base end portion 22. Camshaft 13 is inserted into supporting hole 22*a* to be rotatably supported. Also, a pin hole 23*a* is formed through an end portion 23 positioned at the other end portion 18*c* of rocker arm 18.

A base circular surface 24*a* of base end portion 22 side and a cam surface 24*b* extending in an arc shape from base circular surface 24*a* to an edge of end portion 23, are formed on a bottom surface of swing cam 20. Base circular surface 24*a* and cam surface 24*b* are in contact with a predetermined position of an upper surface of each valve lifter 19 corresponding to a swing position of swing cam 20.

Namely, according to a valve lift characteristic shown in FIG. 8, as shown in FIG. 2, a predetermined angle range $\theta 1$ of base circular surface 24*a* is a base circle interval and a range of from base circle interval $\theta 1$ of cam surface 24*b* to a predetermined angle range $\theta 2$ is a so-called ramp interval, and a range of from ramp interval $\theta 2$ of cam surface 24*b* to a predetermined angle range $\theta 3$ is a lift interval.

Link arm 25 includes a ring-shaped base portion 25*a* and a protrusion end 25*b* protrudingly formed on a predetermined position of an outer surface of base portion 25*a*. A fitting hole 25*c* to be rotatably fitted with the outer surface of cam body 15*a* of eccentric cam 15 is formed on a central position of base portion 25*a*. Also, a pin hole 25*d* into which pin 21 is rotatably inserted is formed through protrusion end 25*b*.

Link member 26 is formed in a linear shape of predetermined length and pin insertion holes 26*c*, 26*d* are formed through both circular end portions 26*a*, 26*b*. End portions of pins 28, 29 pressed into pin hole 18*d* of the other end portion 18*c* of rocker arm 18 and pin hole 23*a* of end portion 23 of swing cam 20, respectively, are rotatably inserted into pin insertion holes 26*c*, 26*d*.

Snap rings 30, 31, 32 restricting axial transfer of link arm 25 and link member 26 are disposed on respective end portions of pins 21, 28, 29.

In such a constitution, depending on a positional relation between the center axis P2 of control shaft 16 and the center axis P1 of control cam 17, as shown in FIG. 6 and FIG. 7, the valve lift amount is varied, and by driving control shaft 16 to rotate, the position of the center axis P2 of control shaft 16 relative to the center axis P1 of control cam 17 is changed.

Figure 10:
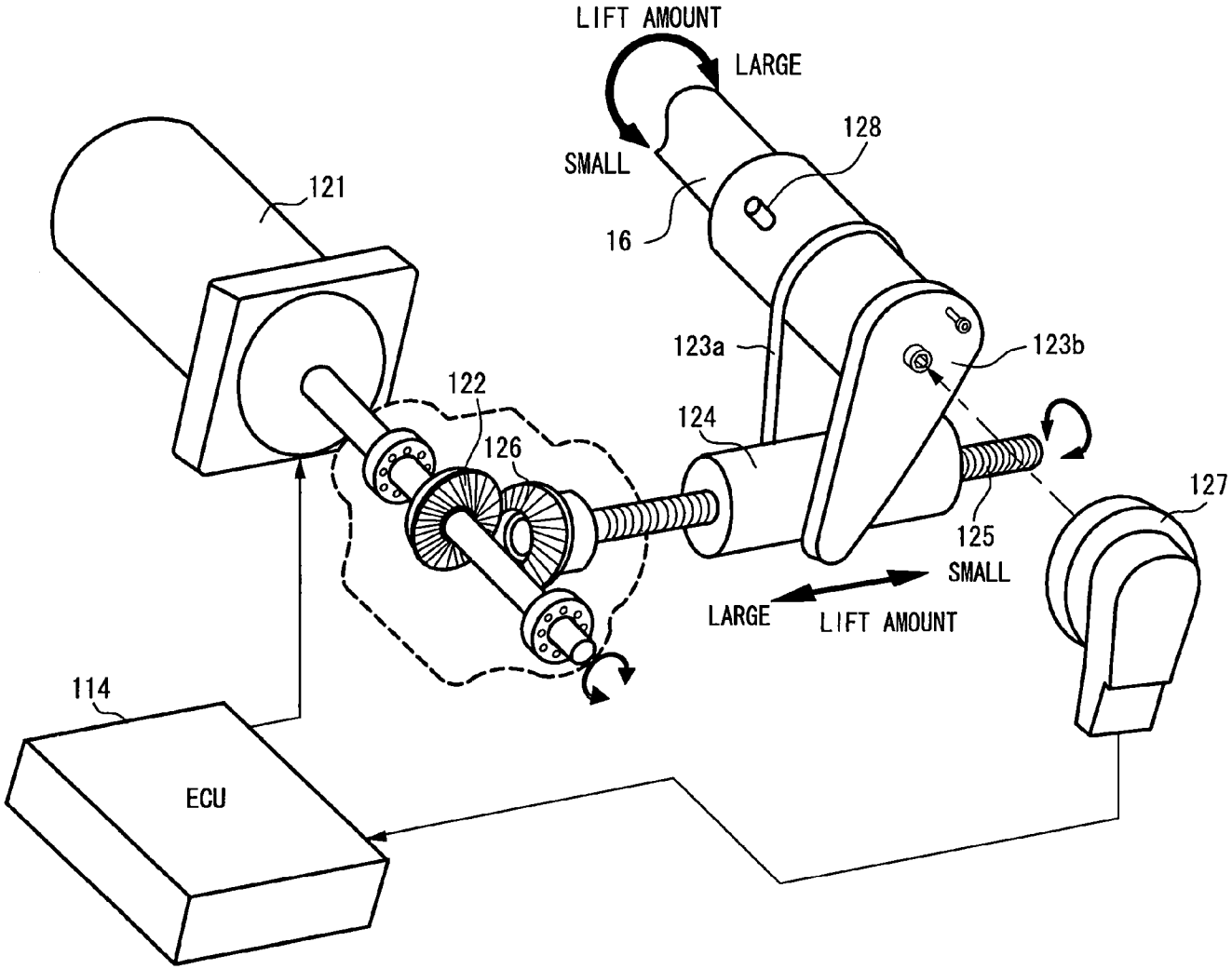
FIG. 10 is a perspective view showing a driving mechanism of a control shaft in the variable valve event and lift mechanism.

Control shaft 16 is driven to rotate within a predetermined rotation angle range, which is restricted by a stopper, by a DC servo motor (actuator) 121 as shown in FIG. 10. By varying a rotation angle of control shaft 16 by actuator 121, the lift amount and operating angle of each of intake valves 105, 105 are continuously varied within a variable range between a maximum valve lift amount and a minimum valve lift amount, which is restricted by the stopper (refer to FIG. 9).

In FIG. 10, DC servo motor 121 is arranged so that a rotation shaft thereof is parallel to control shaft 16, and a bevel gear 122 is axially supported by a tip portion of the rotation shaft.

On the other hand, a pair of stays 123*a*, 123*b* is fixed to the tip end of control shaft 16. A nut 124 is swingingly supported around an axis parallel to control shaft 16 connecting tip portions of the pair of stays 123*a*, 123*b*.

A bevel gear 126 meshed with bevel gear 122 is axially supported at a tip end of a threaded rod 125 engaged with nut 124. Threaded rod 125 is rotated by the rotation of DC servo motor 121, and the position of nut 124 engaged with threaded rod 125 is displaced in an axial direction of threaded rod 125, so that control shaft 16 is rotated.

Here, the valve lift amount is decreased as the position of nut 124 approaches bevel gear 126, while the valve lift amount is increased as the position of nut 124 gets away from bevel gear 126.

Further, a potentiometer type angle sensor 127 detecting the angle of control shaft 16 is disposed on the tip end of control shaft 16, as shown in FIG. 10. VEL controller 113 feedback controls DC servo motor 121 so that an actual angle detected by angle sensor 127 coincides with a target angle (a value equivalent to the target lift amount).

A stopper member 128 which is formed to protrude from the outer periphery of control shaft 16, is in contact with a receiving member on the fixing side (not shown in the figure) in both of a valve lift amount increasing direction and a valve lift amount decreasing direction, so that the rotation range of control shaft 16 is restricted, thereby the minimum valve lift amount and the maximum valve lift amount are defined.

Figure 11:
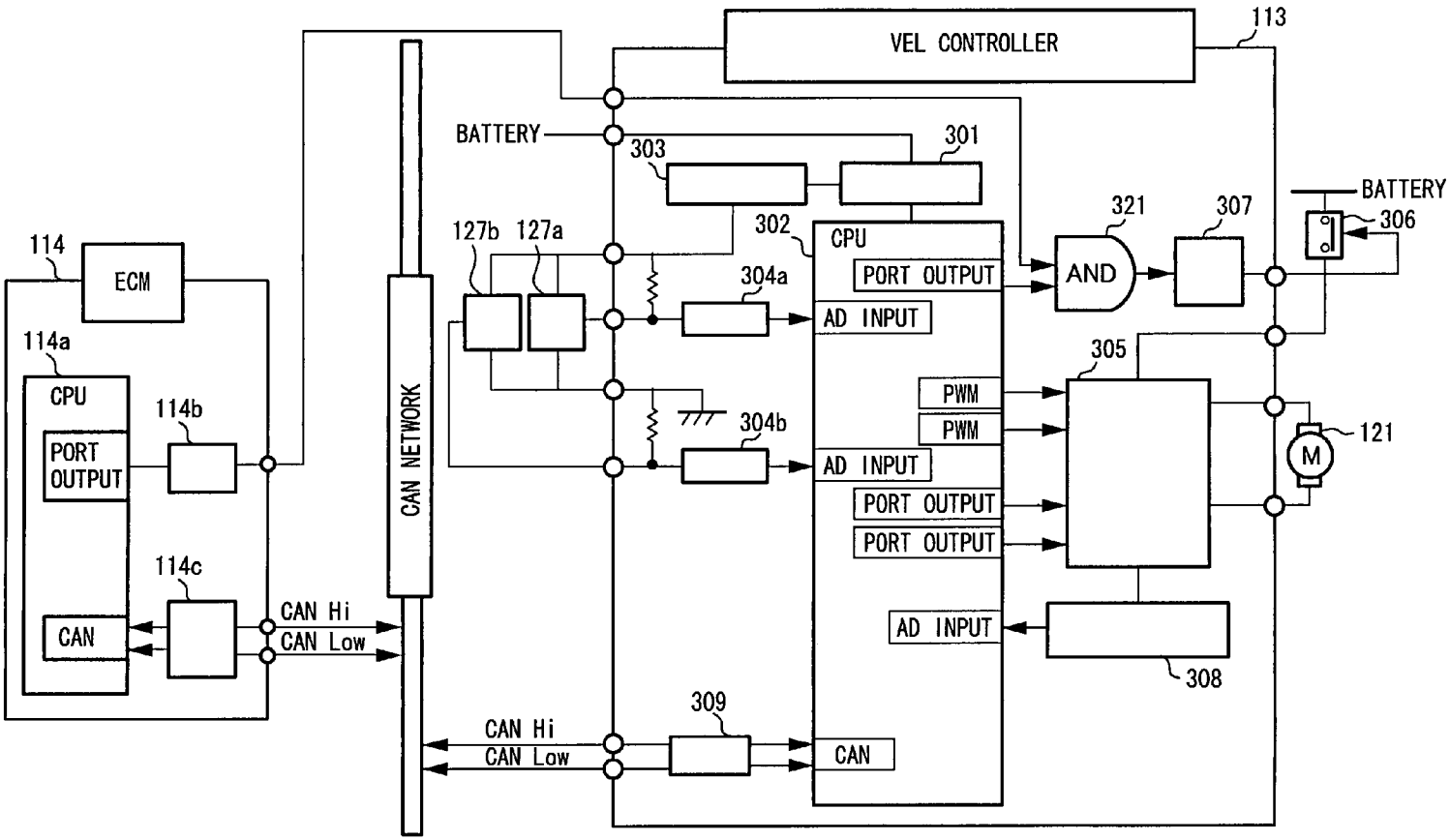
FIG. 11 is a circuit block diagram showing a first embodiment of a VEL controller and an ECM (engine control module).

FIG. 11 shows a configuration of VEL controller 113.

A battery voltage is supplied to VEL controller 113, and the power is supplied to a CPU 302 via a power supply circuit 301.

Further, a power supply voltage from power supply circuit 301 is supplied to angle sensors 127*a*, 127*b* via a power supply buffer circuit 303.

Output signals from angle sensors 127*a*, 127*b* are read in CPU 302 via input circuits 304*a*, 304*b*.

Further, there is disposed a motor drive circuit 305 for driving DC servo motor 121.

Motor drive circuit 305 is a PWM system drive circuit which varies the pulse width of a pulse signal for turning ON/OFF a driving power source for DC servo motor 121 based on a direct current level of a control signal (pulse width modulated signal PWM) output from CPU 302, which varies the ON duty of the pulse signal to control an average voltage of DC servo motor 121.

In order to drive DC servo motor 121 in a normal rotation direction and in a reverse rotation direction, control signals for normal and reverse rotations are input to motor drive circuit 305 from CPU 302, other than the pulse width modulated signal PWM.

A battery voltage is supplied to motor drive circuit 305 via a relay circuit 306.

Relay circuit 306 is driven to turn ON/OFF by a relay drive circuit 307.

Further, there is disposed a current detection circuit 308 which detects a current of DC servo motor 121.

Relay drive circuit 307 turns relay circuit 306 ON to supply the power to motor drive circuit 305, when an output from an AND circuit 321 is at a high level (1).

Further, relay drive circuit 307 turns relay circuit 306 OFF to shut off the power supply to motor drive circuit 305, when the output from AND circuit 321 is at a low level (0).

Input terminals of AND circuit 321 are input with a port output from CPU 302 of VEL controller 113, and also a port output from a CPU 114*a* of ECM 114 via an interface circuit (I/F circuit) 114*b*, so that the AND operation of respective port outputs is performed.

CPU 302 of VEL controller 113 is set to output a reference signal of high level to the input terminal of AND circuit 321.

On the other hand, CPU 114*a* of ECM 114 diagnoses a feedback control function of VEL controller 113 (CPU 302), and outputs a diagnosis signal of high level to the input terminal of AND circuit 321 when it is judged that the feedback control function is normal, while outputting a diagnosis signal of low level to the input terminal of AND circuit 321 when it is judged that the feedback control function is abnormal.

Accordingly, when CPU 302 of VEL controller 113 is operated normally so that the reference signal of high level is output from an output port of CPU 302 to the input terminal of AND circuit 321, and also when CPU 114*a* of ECM 114 judges that the feedback control function of VEL controller 113 is normal to output the diagnosis signal of high level to the input terminal of AND circuit 321, an output terminal of AND circuit 321 becomes high level and relay circuit 306 is turned ON, so that the battery voltage is supplied to motor drive circuit 305 via relay circuit 306.

On the other hand, in the case where CPU 302 of VEL controller 113 is malfunctioned so that the reference signal output to the input terminal of AND circuit 321 becomes low level, and/or when CPU 114*a* of ECM 114 judges the abnormality in the feedback control function of VEL controller 113 and outputs the diagnosis signal of low level to the input terminal of AND circuit 321, the output terminal of AND circuit 321 becomes low level and relay circuit 306 is turned OFF, so that the battery voltage supply to motor drive circuit 305 is shut off by relay circuit 306.

Here, VEL controller 113 is provided with a communication circuit 309 for communicating between VEL controller 113 and ECM 114.

On the other hand, ECM 114 is provided with a communication circuit 114*c* for communicating with VEL controller 113.

Thus, the intercommunication can be performed between VEL controller 113 and ECM 114.

Then, the target angle of control shaft 16 computed in ECM 114 based on the accelerator opening, the engine rotation speed and the like is transmitted to VEL controller 113.

Further, the angle of control shaft 16 detected by angle sensor 127 is transmitted to ECM 114 from VEL controller 113.

ECM 114 judges a convergence state of the actual angle relative to the target angle based on the deviation between the target angle and the angle detected by angle sensor 127, thus performing the failure diagnosis of VEL controller 113.

Figure 12:
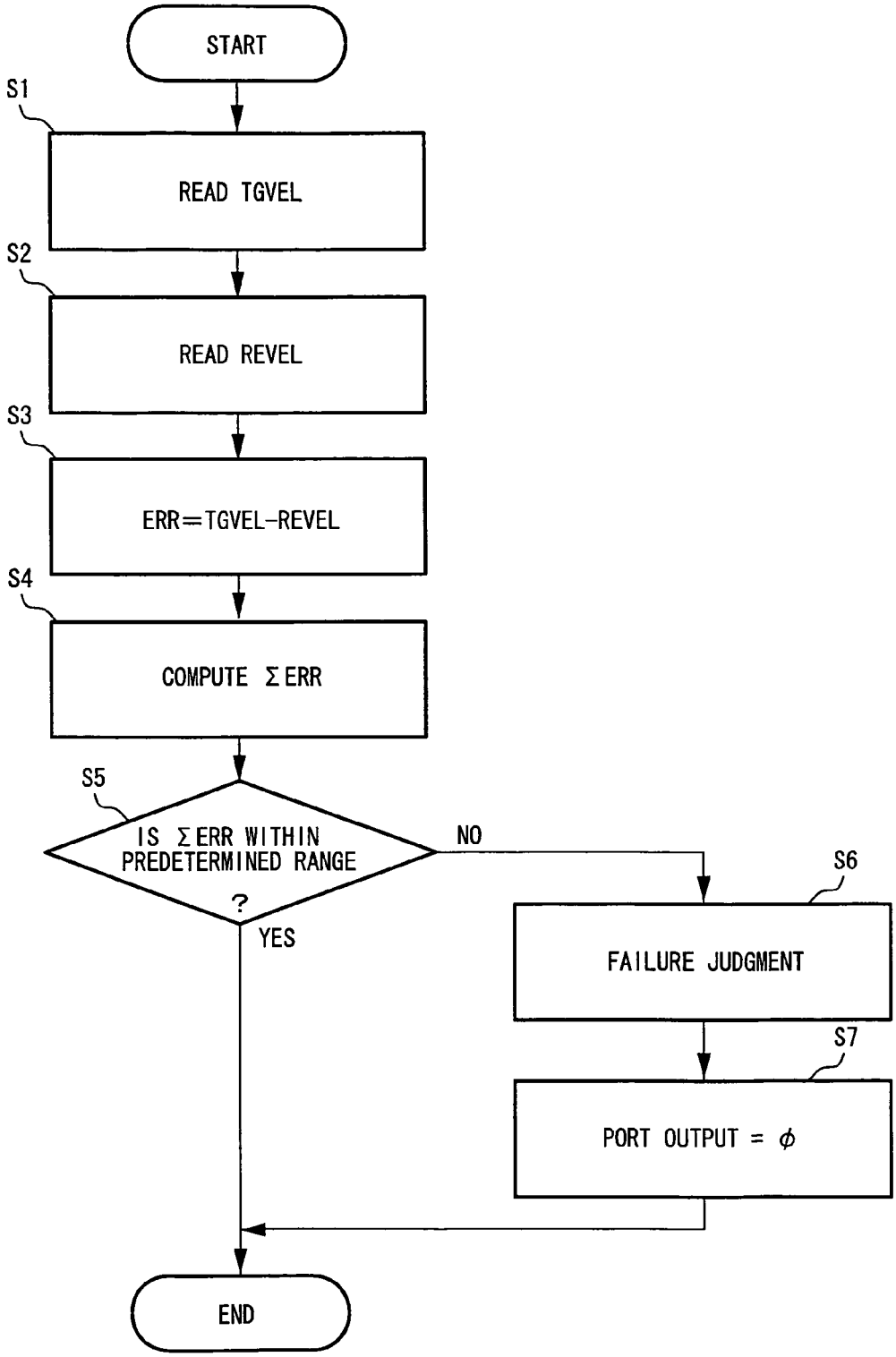
FIG. 12 is a flowchart showing the failure diagnosis of the VEL controller by the ECM.

A flowchart in FIG. 12 shows the failure diagnosis of VEL controller 113 by ECM 114.

In step S1, a target angle TGVEL of control shaft 16 is read.

In step S2, an actual angle REVEL of control shaft 16 transmitted from VEL controller 113 is read.

In step S3, the deviation ERR between the target angle TGVEL and the actual angle REVEL is calculated.

$$ERR = TGVEL - REVEL$$

In step S4, the deviation ERR is integrated to update an integral value ΣERR.

In step S5, it is judged whether or not the integral value ΣERR is within a predetermined range.

Then, when it is judged that the integral value ΣERR is outside the predetermined range and the actual angle REVEL is not converged into the target angle TGVEL at a desired response, control proceeds to step S6.

In step S6, it is judged that VEL controller has failed.

In next step S7, the diagnosis signal of low level is output to the input terminal of AND circuit 321.

When the diagnosis signal of low level is output to the input terminal of AND circuit 321 from ECM 114, even if the reference signal of high level is output to the input terminal of AND circuit 321 from CPU 302 of VEL controller 113, the output from AND circuit 321 is switched to be at a low level.

As a result, relay circuit 306 is turned OFF, and the supply of battery voltage to motor drive circuit 305 is shut off by relay circuit 306, so that the driving of DC servo motor 121 (electric actuator) is stopped.

On the other hand, even if ECM 114 judges that VEL controller is operated normally, if CPU 302 of VEL controller 113 is malfunctioned and the reference signal output to the input terminal of AND circuit 321 becomes low level, the output from AND circuit 321 is switched to be at a low level.

As a result, relay circuit 306 is turned OFF, and the supply of battery voltage to motor drive circuit 305 is shut off by relay circuit 306, so that the driving of DC servo motor 121 (electric actuator) is stopped.

Note, the failure diagnosis method for VEL controller 113 is not limited to the method shown in the flowchart of FIG. 12.

Figure 13:
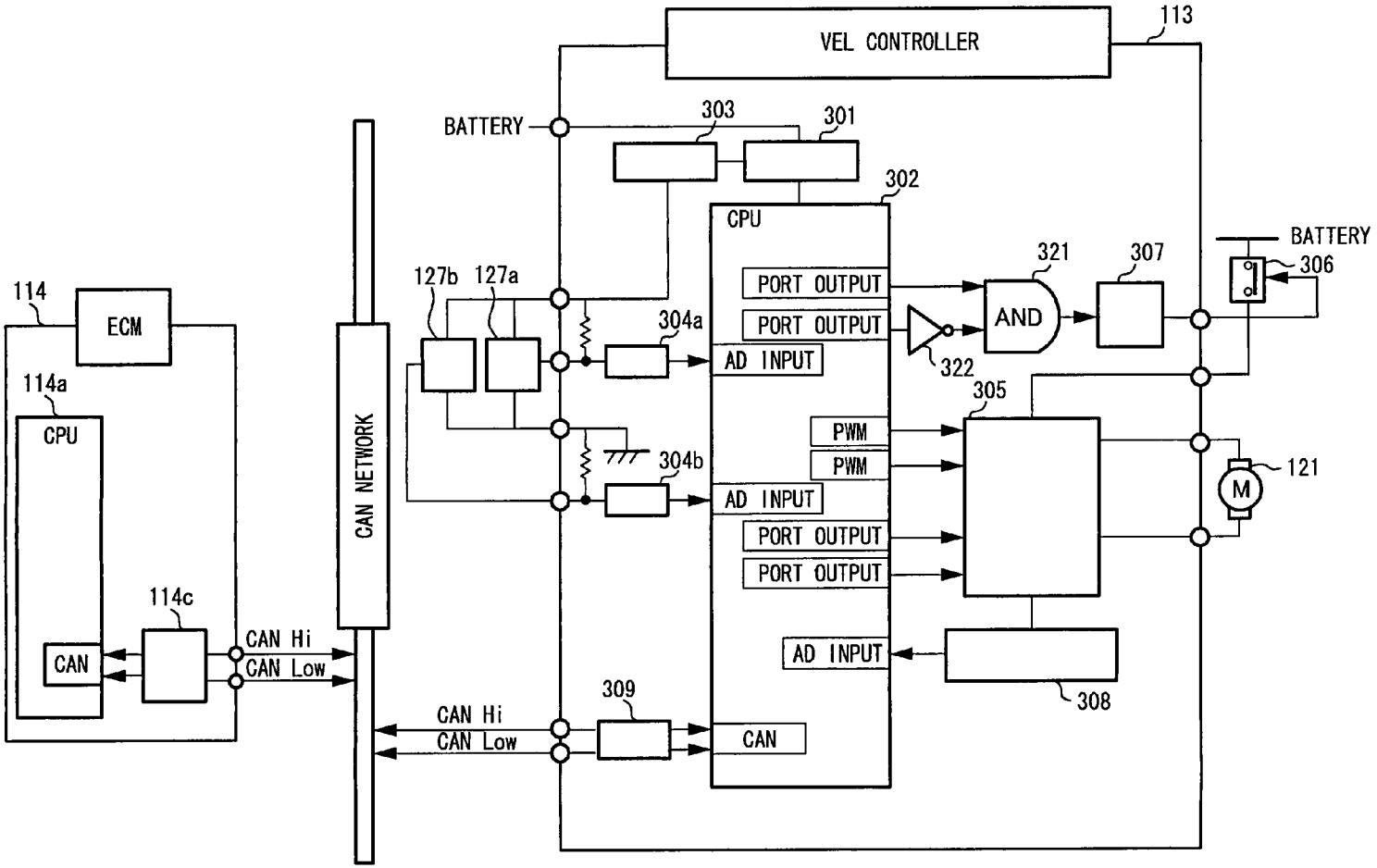
FIG. 13 is a circuit diagram showing a second embodiment of the VEL controller and the ECM.

FIG. 13 shows configurations of VEL controller 113 and ECM 114 in a second embodiment.

In the second embodiment shown in FIG. 13, reference signals respectively output from two output ports of CPU 302 of VEL controller 113 are input to two input terminals of AND circuit 321, so that the ON/OFF of relay circuit 306 is controlled based on only the signals from the output ports of CPU 302.

Here, one of the two output ports of CPU 302 is directly connected to the input terminal of AND circuit 321. However, the other port is connected to a NOT gate 322, so that an inverted signal thereof is input to the input terminal of AND circuit 321.

Then, the reference signal of low level is output from the output port on the side where NOT gate 322 is disposed, and the reference signal of high level is output from the output port on the side where NOT gate 322 is not disposed, so that both input terminals of AND circuit 321 become high level and a result of logical product becomes high level. As a result, relay circuit 306 is turned ON.

Here, if both reference signals output from both of the output ports become low level due to the failure of CPU 302, the reference signal of low level is output to AND circuit 321 from the output port on the side where NOT gate 322 is not disposed, so that the result of logical product in AND circuit 321 becomes low level. As a result, relay circuit 306 is turned OFF.

Contrary to the above, if outputs from both of the output ports become high level due to the failure of CPU 302, the reference signal input to AND circuit 321 via NOT gate 322 becomes low level, so that the result of logical product in AND circuit 321 becomes low level. As a result, relay circuit 306 is turned OFF.

Namely, if the reference signals of same level are output from the two output ports due to the failure of CPU 302, since relay circuit 306 is turned OFF, it is possible to stop the driving of motor drive circuit 305 (DC servo motor 121) when VEL controller 113 has failed.

Figure 14:
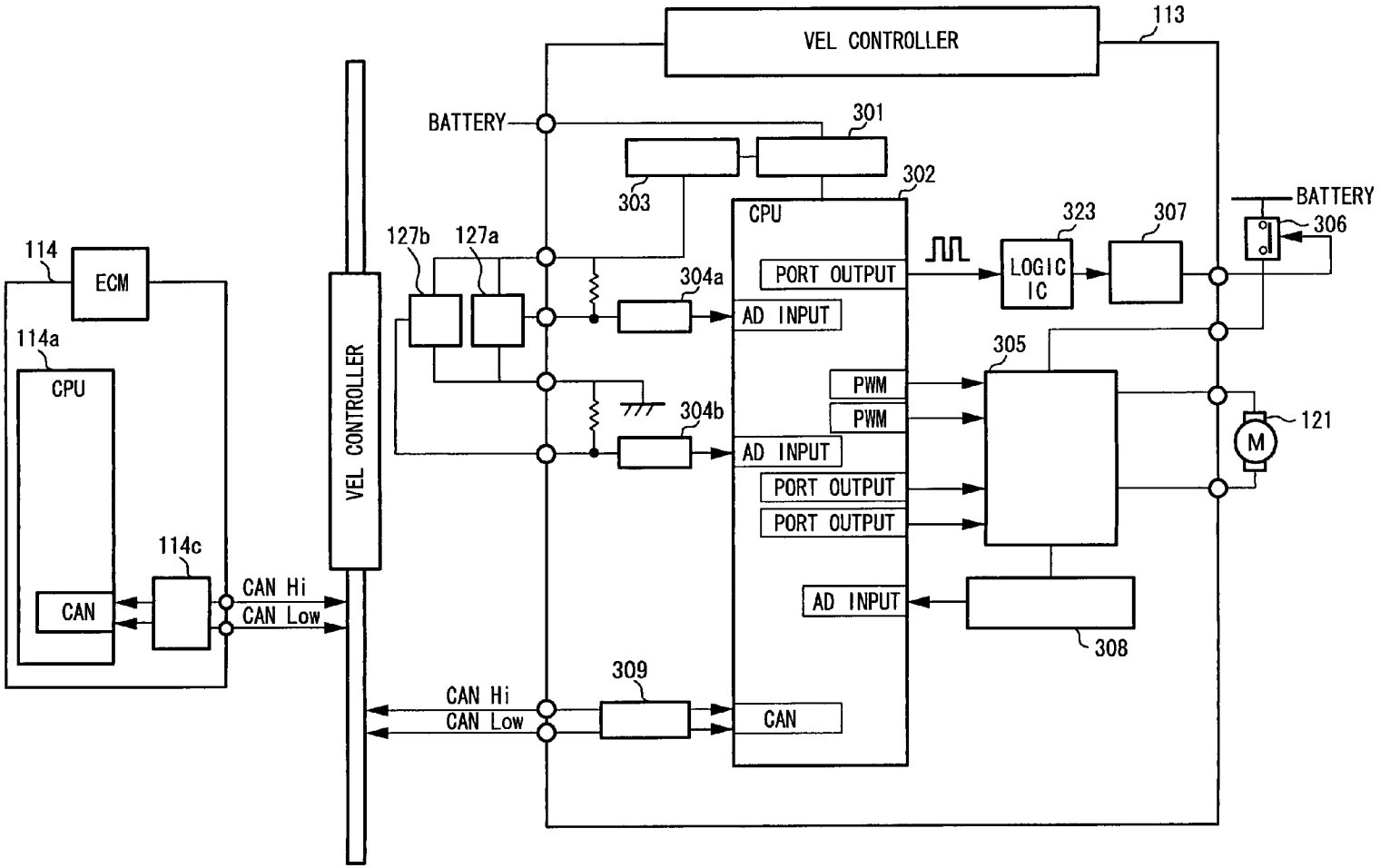
FIG. 14 is a circuit diagram showing a third embodiment of the VEL controller and the ECM.

FIG. 14 shows configurations of VEL controller 113 and ECM 114 in a third embodiment.

In the third embodiment shown in FIG. 14, the ON/OFF of relay drive circuit 307 is controlled by a logic IC 323.

Further, a reference signal of previously set frequency is input to logic IC 323 from the output port of CPU 302 of VEL controller 113.

Here, a processing function of logic IC 323 will be described in accordance with a flowchart in FIG. 15.

Figure 15:
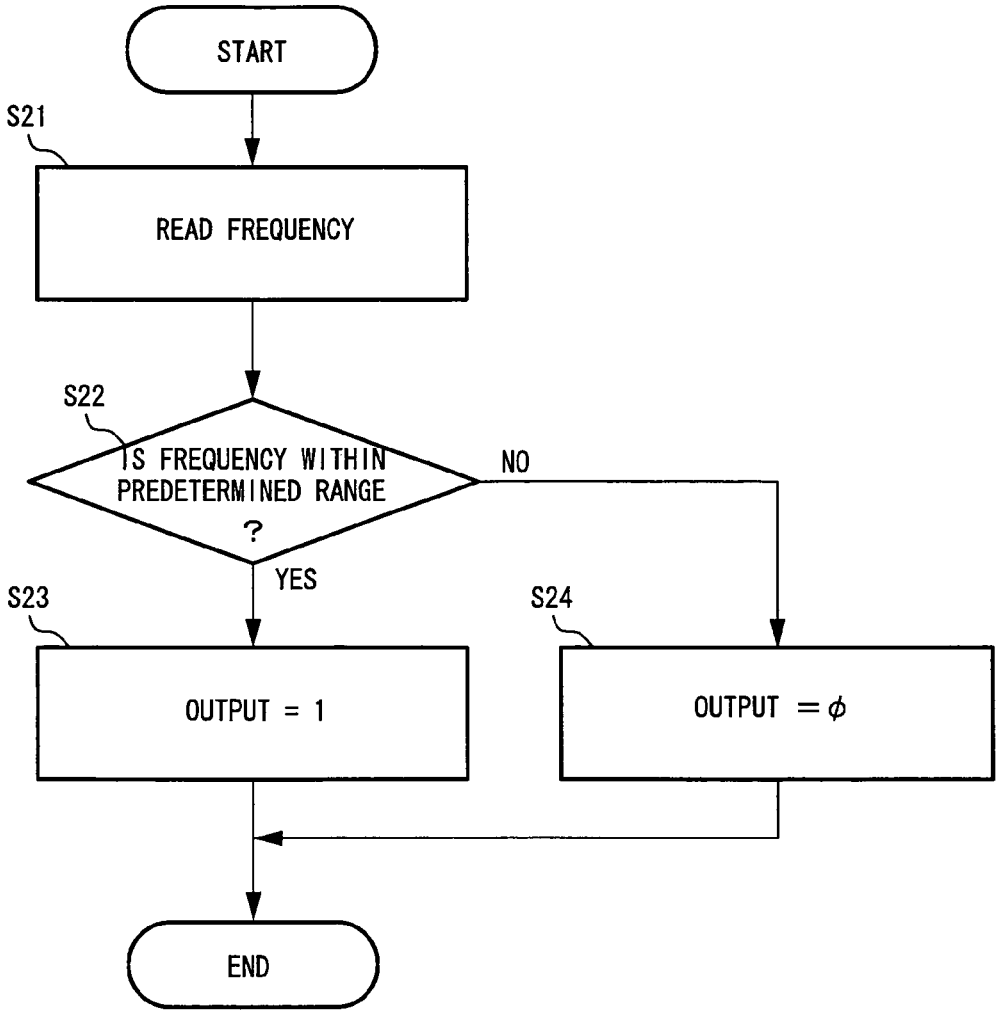
FIG. 15 is a flowchart showing the computation processing of a logic IC in the third embodiment.

In the flowchart of FIG. 15, in step S21, the frequency of the reference signal output from the output port of CPU 302 is measured.

In step S22, it is judged whether the measured frequency is within a predetermined range.

If CPU 302 of VEL controller 113 is operated normally, a signal of constant frequency is output from the output port of CPU 302, and accordingly, the frequency measurement result is within the predetermined range.

On the contrary, if CPU 302 of VEL controller 113 is malfunctioned and consequently, cannot output the reference signal of desired frequency, the frequency measurement result deviates from the predetermined range.

Therefore, if it is judged in step S22 that the frequency measurement result is within the predetermined range, control proceeds to step S23, where an output from logic IC 323 is set to be at a high level, to turn relay circuit 306 ON, so that the battery voltage is supplied to motor drive circuit 305.

On the other hand, if it is judged in step S22 that the frequency measurement result is outside the predetermined range, control proceeds to step S24, where the output from logic IC 323 is reset to be at a low level, to turn relay circuit 306 OFF, so that the supply of battery voltage to motor drive circuit 305 is shut off.

Figure 16:
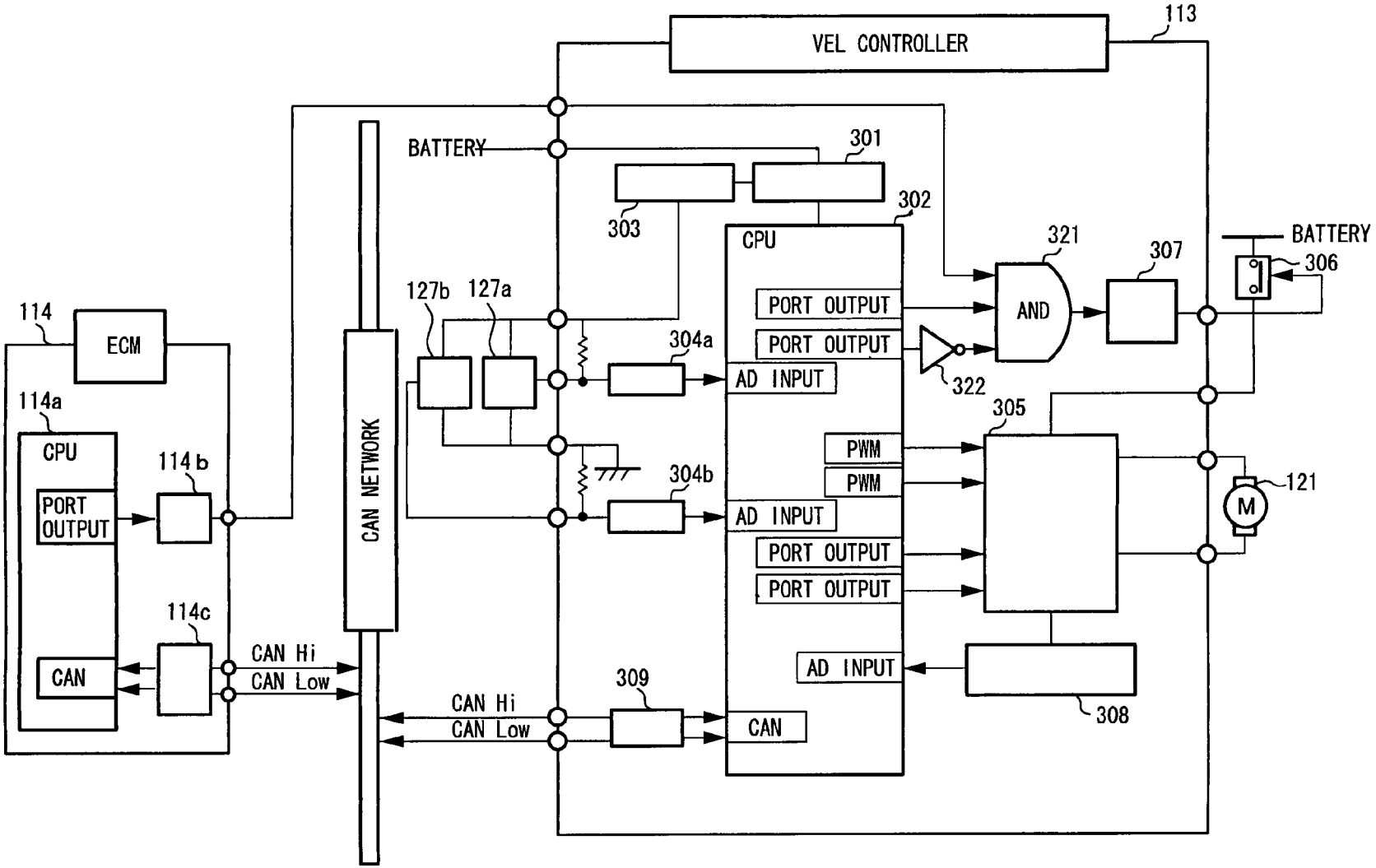
FIG. 16 is a circuit diagram showing a fourth embodiment of the VEL controller and the ECM.

FIG. 16 shows configurations of VEL controller 113 and ECM 114 in a fourth embodiment.

In the fourth embodiment shown in FIG. 16, there is provided AND circuit 321 which controls relay drive circuit 307, and at the same time, the diagnosis signal output from ECM 114 according to the diagnosis result of VEL controller 113 is input to the input terminal of AND circuit 321.

Further, the mutually inverted reference signals are output from the two output ports of CPU 302 of VEL controller 113, and at the same time, NOT gate 322 is connected to one of the two output ports, from which the reference signal of low level is output, so that the two reference signals of high level are input to AND circuit 322 if CPU 302 is operated normally.

Here, similarly to the first embodiment, ECM 114 performs the failure diagnosis of VEL controller 113 based on, for example, the deviation between the target angle of control shaft 16 and the actual angle thereof, and outputs the diagnosis signal of high level to AND circuit 321 when VEL controller 113 is operated normally, while outputting the diagnosis signal of low level to AND circuit 321 when it is judged that VEL controller 113 has failed.

Further, CPU 302 of VEL controller 113 sets the output port directly connected to the input terminal of AND circuit 321 to be at a high level, and sets the output port connected to the input terminal of AND circuit 321 via NOT gate 322 to be at a low level.

Accordingly, if ECM 114 diagnoses the normal condition of VEL controller 113, and further, CPU 302 of VEL controller 113 is operated normally, all the three input terminals of AND circuit 321 become high level, so that the output from AND circuit 321 becomes high level. As a result, relay circuit 306 is turned ON.

On the other hand, if ECM 114 judges the failure of VEL controller 113 and/or if the output ports of CPU 302 of VEL controller 113 become all high level or low level due to the failure, at least one of the three input terminals of AND circuit 321 becomes low level, so that the output from AND circuit 321 becomes low level. As a result, relay circuit 306 is turned OFF.

Thus, it is possible to reliably stop the driving of motor drive circuit 305 (DC servo motor 121) when VEL controller 113 has failed.

Note, in the present embodiment, DC servo motor 121 of VEL mechanism 112 is the electric actuator as an object to be controlled. However, the electric actuator is not limited to DC servo motor 121 of VEL mechanism 112, and further, may be an electromagnetic solenoid or the like.

Further, as the apparatus for diagnosing the failure of VEL controller 113, a control unit of an automatic transmission can be used other than ECM 114, and further, a microcomputer or an IC dedicated for the failure diagnosis may be used.

Moreover, the logic circuit is not limited to the AND circuit. It is also possible to control relay drive circuit 307 with an output from an OR circuit, for example.

The entire contents of Japanese Patent Application No. 2004-031728 filed on Feb. 9, 2004, a priority of which is claimed, are incorporated herein by reference.

While only selected embodiments have been chosen to illustrate the present invention, it will be apparent to those skilled in the art from this disclosure that various changes and modifications can be made herein without departing from the scope of the invention as defined in the appended claims.

Furthermore, the foregoing description of the embodiments according to the present invention is provided for illustration only, and not for the purpose of limiting the invention as defined in the appended claims and their equivalents.

We claim:

1. A drive control apparatus of a variable valve lift mechanism for continuously variably controlling a valve lift amount of an engine valve by driving an electric actuator, comprising:

a lift control device including:

a drive circuit of the electric actuator;

a control circuit which controls the drive circuit to operate and stop; and a CPU which computes a manipulated variable so that the valve lift amount of the engine valve is a target valve lift amount, outputs the manipulated variable to the drive circuit, and outputs a binary signal which differs between when a calculation function of an operation amount is normal and when the calculation function of the operation amount is abnormal; and a fuel injection control device which computes at least a fuel injection amount of an engine, and outputs an injection pulse signal in accordance with the fuel injection amount to a fuel injection valve, wherein the fuel injection control device receives a signal of an actual valve lift amount from the CPU of the lift control device, judges whether a control function of the CPU of the lift control device is normal or abnormal on a basis of deviation between the target valve lift amount and the actual valve lift amount, and outputs a binary signal which differs between when the control function of the CPU of the lift control device is normal and when the control function of the CPU of the lift control device is abnormal, wherein the lift control device receives the binary signal outputted from the CPU and the binary signal outputted from the fuel injection control device, wherein the lift control device further comprises a stop instruction circuit for outputting a signal which instructs the control circuit to stop the drive circuit when at least one of the binary signal outputted from the CPU and the binary signal outputted from the fuel injection control device is a signal indicating abnormality, wherein the electric actuator is an electric motor, and when the stop instruction circuit outputs the signal which instructs the control circuit to stop the drive circuit, the control circuit shuts off power supplied to the drive circuit.

2. The drive control apparatus of the variable valve lift mechanism according to claim 1, wherein the control circuit comprises:

a relay circuit disposed in a line for supplying power to the drive circuit, the relay circuit supplying the power to the drive circuit in an ON state, and shutting off the power being supplied to the drive circuit in an OFF state; and a relay drive circuit which controls the ON and OFF states of the relay circuit; and wherein the stop instruction circuit is an AND gate which receives the binary signal outputted from the CPU and the binary signal outputted from the fuel injection control device, wherein the binary signal outputted from the CPU and the binary signal outputted from the fuel injection control device indicate abnormality when the binary signal outputted from the CPU and the binary signal outputted from the fuel injection control device are at low levels, wherein the binary signal outputted from the CPU and the binary signal outputted from the fuel injection control device indicate normality when the binary signal outputted from the CPU and the binary signal outputted from the fuel injection control device are at high levels, and wherein the relay drive circuit turns on the relay circuit when a signal outputted from the AND gate is at a high level, and the relay drive circuit turns off the relay circuit when the signal output from the AND gate is at a low level.

3. The drive control apparatus of the variable valve lift mechanism according to claim 1, wherein the binary signal outputted from the CPU and the binary signal outputted from the fuel injection control device indicate abnormality when the binary signal outputted from the CPU and the binary signal outputted from the fuel injection control device are at a low level, and indicate normality when the binary signal outputted from the CPU and the binary signal outputted from the fuel injection control device are at a high level, and wherein the stop instruction circuit outputs the signal which instructs the control circuit to stop the drive circuit when the binary signal outputted from the CPU is at a high level and the binary signal outputted from the fuel injection control device is at a low level.

4. The drive control apparatus of the variable valve lift mechanism according to claim 1, wherein the binary signal outputted from the CPU and the binary signal outputted from the fuel injection control device indicate abnormality when the binary signal outputted from the CPU and the binary signal outputted from the fuel injection control device are at a low level, and indicate normality when the binary signal outputted from the CPU and the binary signal outputted from the fuel injection control device are at a high level, and wherein the stop instruction circuit outputs the signal which instructs the control circuit to stop the drive circuit when the binary signal outputted from the CPU is at a low level and the binary signal outputted from the fuel injection control device is at a high level.

5. The drive control apparatus of the variable valve lift mechanism according to claim 1, wherein the binary signal outputted from the CPU and the binary signal outputted from the fuel injection control device indicate abnormality when the binary signal outputted from the CPU and the binary signal outputted from the fuel injection control device are at a low level, and indicate normality when the binary signal outputted from the CPU and the binary signal outputted from the fuel injection control device are at a high level, and wherein the stop instruction circuit outputs the signal which instructs the control circuit to stop the drive circuit, when the binary signal outputted from the CPU is at a low level and the binary signal outputted from the fuel injection control device is at a low level.

6. The drive control apparatus of the variable valve lift mechanism according to claim 1, wherein the stop instruction circuit comprises a logic circuit.

7. A drive control apparatus of a variable valve lift mechanism for continuously variably controlling a lift amount of an engine valve by driving an electric actuator, comprising:

a relay circuit configured to shut off power supplied to the electric actuator;

a relay control unit configured to output a drive signal to the relay circuit;

a lift control device configured to compute a manipulated variable so that the lift amount of the engine valve is a target valve lift amount, output the manipulated variable to a drive circuit of the electric actuator, and output a binary signal which differs between when a calculation function of an operation amount is normal and when the calculation function of the operation amount is abnormal, to the relay control unit; and a fuel injection control unit configured to compute at least a fuel injection amount of an engine, output an injection pulse signal in accordance with the fuel injection amount to a fuel injection valve, receive a signal of an actual valve lift amount from the lift control device, judge whether a control function of the lift control device is normal or abnormal on a basis of deviation between the target valve lift amount and the actual valve lift amount, and output a binary signal which differs between when the control function of the lift control device is normal and when the control function of the lift control device is abnormal, to the relay control unit, wherein the relay control unit is configured to stop the drive signal to the relay circuit when at least one of the binary signal outputted from the lift control device and the binary signal outputted from the fuel injection control unit is a signal indicating abnormality, to thereby stop the power supplied to the electric actuator, wherein the electric actuator is an electric motor, and the relay circuit is configured to shut off the power supplied to the drive circuit of the electric actuator.

8. The drive control apparatus of the variable valve lift mechanism according to claim 7, wherein the relay control unit comprises an AND gate configured to output the drive signal to the relay circuit and receive the binary signal outputted from the lift control device and the binary signal outputted from the fuel injection control unit, wherein the lift control device is configured to output the binary signal of the lift control device such that a normal calculation function of the operation amount is indicated at a high level and an abnormal calculation function of the operation amount is indicated at a low level, wherein the fuel injection control unit is configured to output the binary signal of the fuel injection control unit such that a normal control function of the lift control device is indicated at a high level and an abnormal control function of the lift control device is indicated at a low level, and wherein the relay control unit is configured to turn on the relay circuit when the drive signal outputted from the AND gate is at a high level such that the power is supplied to the electric actuator.

9. The drive control apparatus of the variable valve lift mechanism according to claim 7, wherein the lift control device is configured to output the binary signal of the lift control device such that a normal calculation function of the operation amount is indicated at a high level and an abnormal calculation function of the operation amount is indicated at a low level, wherein the fuel injection control unit is configured to output the binary signal of the fuel injection control unit such that a normal control function of the lift control device is indicated at a high level and an abnormal control function of the lift control device is indicated at a low level, and wherein the relay control unit is configured to turn off the relay circuit when the binary signal outputted from the lift control device is at a high level and the binary signal outputted from the fuel injection control unit is at a low level such that the power supplied to the electric actuator is shut off.

10. The drive control apparatus of the variable valve lift mechanism according to claim 7, wherein the lift control device is configured to output the binary signal of the lift control device such that a normal calculation function of the operation amount is indicated at a high level and an abnormal calculation function of the operation amount is indicated at a low level, wherein the fuel injection control unit is configured to output the binary signal of the fuel injection control unit such that a normal control function of the lift control device is indicated at a high level and an abnormal control function of the lift control device is indicated at a low level, and wherein the relay control unit is configured to turn off the relay circuit when the binary signal outputted from the lift control device is at a low level and the binary signal outputted from the fuel injection control unit is at a high level such that the power supplied to the electric actuator is shut off.

11. The drive control apparatus of the variable valve lift mechanism according to claim 7, wherein the lift control device is configured to output the binary signal of the lift control device such that a normal calculation function of the operation amount is indicated at a high level and an abnormal calculation function of the operation amount is indicated at a low level, wherein the fuel injection control unit is configured to output the binary signal of the fuel injection control unit such that a normal control function of the lift control device is indicated at a high level and an abnormal control function of the lift control device is indicated at a low level, and wherein the relay control unit is configured to turn off the relay circuit when the binary signal outputted from the lift control device is at a low level and the binary signal outputted from the fuel injection control unit is at a low level such that the power supplied to the electric actuator is shut off.

12. The drive control apparatus of the variable valve lift mechanism according to claim 7, wherein the relay control unit comprises a logic circuit.

* * * * *